US007164308B2

(12) United States Patent
Lee

(10) Patent No.: US 7,164,308 B2
(45) Date of Patent: Jan. 16, 2007

(54) TEMPERATURE COMPENSATED BANDGAP VOLTAGE REFERENCE

(75) Inventor: Chik Yam Lee, Courtaboeuf Cedex (FR)

(73) Assignee: International Rectifier Corporation, El Segundo, CA (US)

( * ) Notice: Subject to any disclaimer, the term of this patent is extended or adjusted under 35 U.S.C. 154(b) by 18 days.

(21) Appl. No.: 10/713,928

(22) Filed: Nov. 14, 2003

(65) Prior Publication Data

US 2004/0140844 A1 Jul. 22, 2004

Related U.S. Application Data

(60) Provisional application No. 60/441,063, filed on Jan. 17, 2003.

(51) Int. Cl.
*G05F 1/10* (2006.01)
*G05F 3/02* (2006.01)

(52) U.S. Cl. ..... 327/539

(58) Field of Classification Search ..... 327/539; 323/313

See application file for complete search history.

(56) References Cited

U.S. PATENT DOCUMENTS 5,394,078 A 2/1995 Brokaw et al. ..... 323/313
5,686,823 A 11/1997 Rapp et al. ..... 323/313
6,005,374 A * 12/1999 Tasdighi ..... 323/273
6,181,121 B1 * 1/2001 Kirkland et al. ..... 323/313
6,225,850 B1 * 5/2001 Opris ..... 327/356
6,288,525 B1 * 9/2001 Fischer ..... 323/313

FOREIGN PATENT DOCUMENTS

| | | |
|---|---|---|
| JP | 58-221507 | 12/1983 |
| JP | 03-186910 | 8/1991 |
| JP | 9-504273 | 4/1997 |
| JP | 2002-108467 | 4/2002 |
| WO | 97/44722 | 11/1997 |

* cited by examiner

*Primary Examiner*—Quan Tra
(74) *Attorney, Agent, or Firm*—Ostrolenk, Faber, Gerb & Soffen, LLP

(57) ABSTRACT

A bandgap voltage reference circuit comprising a first circuit providing a first voltage representative of to $V_{be}$ of a first bipolar transistor, a second circuit providing a second voltage $\Delta V_{be}$ representative of the difference of two $V_{be}$ voltages of two bipolar transistors, and a comparator having respective inputs receiving voltages representative of $V_{be}$ and $\Delta V_{be}$ and an output coupled to the base of the first bipolar transistor whereby a voltage representative of the sum of respective constants multiplying $V_{be}$ and $\Delta V_{be}$ is provided at the output of the comparator.

2 Claims, 3 Drawing Sheets

TEMPERATURE COMPENSATED BANDGAP VOLTAGE REFERENCE

CROSS REFERENCE TO RELATED APPLICATIONS

This application is based on and claims priority of U.S. provisional patent application Ser. No. 60/441,063, filed Jan. 17, 2003, entitled TEMPERATURE COMPENSATED BANDGAP VOLTAGE REFERENCE, the entire disclosure of which is incorporated herein by reference.

BACKGROUND OF THE INVENTION

The present invention is directed to a temperature compensated bandgap voltage reference.

FIG. 1 shows how a reference voltage based upon $V_{be}$ of a bipolar transistor can be obtained. The current source I is provided in the emitter path of a bipolar transistor. A plurality of current sources can be provided each coupled to an FET of varying size to provide current sources of different magnitude, e.g., I, 10I, etc. as shown.

$V_{be}$ of a bipolar transistor decreases with increasing temperature in a well-known fashion. See FIG. 3. It is also known that a current mirror can be used to obtain a voltage representative of $\Delta V_{be}$ i.e., the difference between the $V_{be}$ of two bipolar transistors. FIG. 2 shows such a current mirror circuit. $\Delta V_{be}$ is equal to $V_{be2}$ minus $V_{be1}$ and $\Delta V_{be}$ is equal to kt/q ln NI/I. $\Delta V_{be}$ depends upon the ratio of the currents of the current sources as well as the temperature. In particular, $\Delta V_{be}$ increases with temperature. See FIG. 3. By combining the two circuits, it is possible to compensate $V_{be}$ of a first transistor with $\Delta V_{be}$ obtained via two other transistors Q1 and Q2, to obtain a substantially constant reference voltage Vref as shown in FIG. 3. In particular, Vref is equal to a constant A times $V_{be}$ plus a constant B times $\Delta V_{be}$.

SUMMARY OF THE INVENTION

The invention provides a new implementation of a $V_{be}$ bandgap voltage reference that sums $V_{be}$ and $\Delta V_{be}$ to obtain a substantially constant temperature independent voltage reference. The circuit uses a current mirror for $\Delta V_{be}$ and a bipolar transistor to provide $V_{be}$. A comparator is implemented as a differential amplifier and receives inputs proportional to $V_{be}$ and $\Delta V_{be}$. The output of the comparator is coupled back to the input of the bipolar transistor that provides $V_{be}$.

According to one aspect, the invention comprises a bandgap voltage reference circuit comprising a first circuit providing a first voltage representative of $V_{be}$ of a first bipolar transistor, a second circuit providing a second voltage $\Delta V_{be}$ representative of the difference of two $V_{be}$ voltages of two bipolar transistors; and a comparator having respective inputs which receive voltages representative of $V_{be}$ and $\Delta V_{be}$ and an output coupled to the base of the first bipolar transistor whereby a voltage representative of the sum of respective constants multiplying $V_{be}$ and $\Delta V_{be}$ is provided at the output of the comparator.

According to another aspect, the invention comprises a bandgap voltage reference circuit comprising a first bipolar transistor providing substantially a reference voltage $V_{be}$, a current mirror circuit comprising two bipolar transistors coupled in a current mirror arrangement for providing a voltage difference $\Delta V_{be}$ comprising substantially a difference signal between the respective $V_{be}$ voltages of the two bipolar transistors; and a comparator having respective inputs which receive voltages representative of $V_{be}$ and $\Delta V_{be}$ and an output coupled to the base of the first bipolar transistor whereby a voltage representative of the sum of respective constants multiplying $V_{be}$ and $\Delta V_{be}$ is provided at the output of the comparator.

According to yet another aspect, the invention comprises a bandgap voltage reference circuit comprising a first circuit providing a first voltage representative of $V_{be}$ of a first bipolar transistor, a second circuit providing a second voltage $\Delta V_{be}$ representative of the difference of two $V_{be}$ voltages of two bipolar transistors, and a comparator having respective inputs which receive voltages representative of $V_{be}$ and $\Delta V_{be}$ and an output coupled to the base of the first bipolar transistor whereby a substantially temperature independent voltage reference is provided at the output of the comparator.

DETAILED DESCRIPTION OF THE INVENTION

Figure 1:
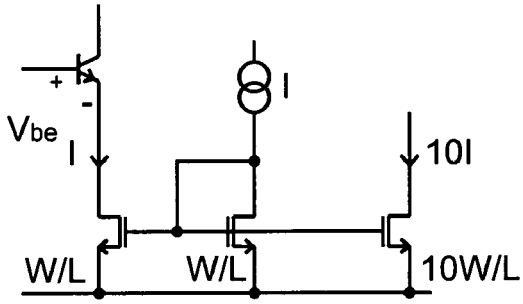
Figure 1 Prior Art
FIG. 1 shows a prior art circuit for generating a reference voltage based on $V_{be}$ of a bipolar transistor.
Figure 2:
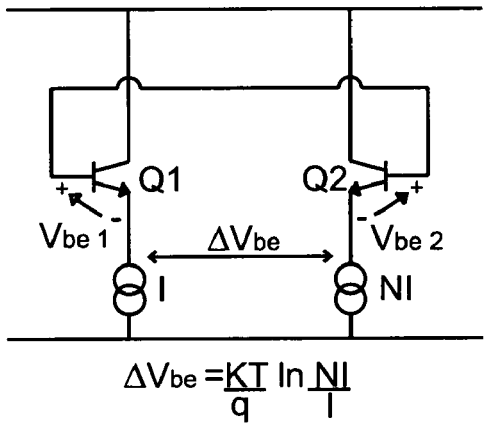
Figure 2 Prior Art
FIG. 2 shows a prior art circuit mirror circuit for generating a voltage proportional to $\Delta V_{be}$.
Figure 3:
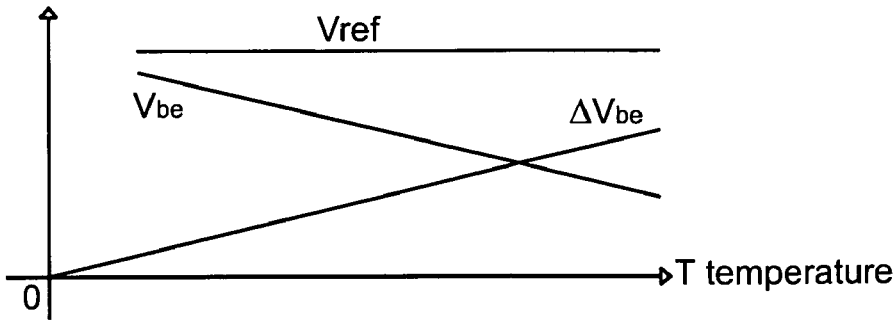
FIG. 3 is a graph showing the relationship of $V_{be}$ and $\Delta V_{be}$ and a reference voltage comprising weighted sums of $V_{be}$ and $\Delta V_{be}$.
Figure 4:
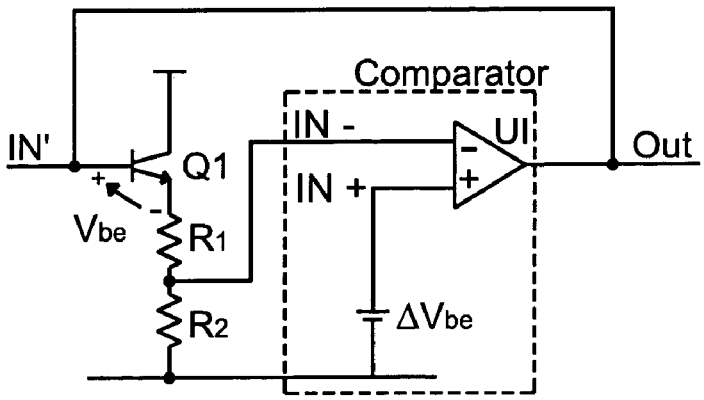
FIG. 4 shows the reference voltage generating circuit according to the invention.

According to the invention, a new implementation for deriving the voltage bandgap reference Vref is provided. As shown in FIG. 4, a bipolar transistor Q1 provides $V_{be}$. The emitter of the bipolar transistor Q1 is coupled to a resistor divider comprising resistors R1 and R2. The output of the divider is provided to a comparator UI inverting input. The non-inverting input of the comparator UI is provided to the voltage source comprising $\Delta V_{be}$, which may be generated by the circuit of FIG. 2. The output of the comparator is provided back to the input IN'. This results in the following equations:

$$IN - = (IN' - V_{be})x\frac{R_2}{R_1 + R_2}$$

$$\Delta V_{be} = (IN'_{\Delta Vbe} - V_{be})x\frac{R_2}{R_1 + R_2}$$

$$IN' = OUT$$

$$OUT = IN'_{\Delta Vbe} \text{ (from FIG. 5B)}$$

$$IN'_{\Delta Vbe} = V_{be} + \frac{R_1 + R_2}{R_2}\Delta V_{be}$$

$$IN'_{\Delta Vbe} = OUT = V_{be} + \frac{R_1 + R_2}{R^2_{(1)}}\Delta V_{be}$$

Figure 5A:
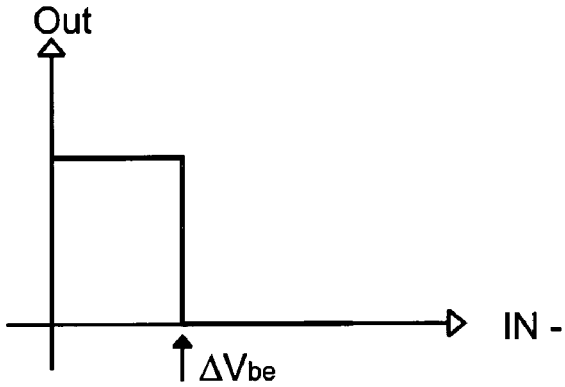
FIGS. 5A and 5B shows waveforms of the circuit of FIG. 4.
Figure 5B:
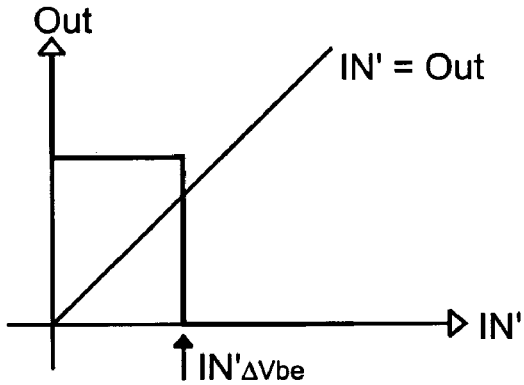

The output of the comparator is shown in FIGS. 5A and 5B versus IN− and IN', respectively. FIG. 5A shows the output versus IN− i.e., versus the input at the inverting input of the comparator. FIG. 5B shows the output versus IN', i.e., versus the input to the transistor Q1 providing the $V_{be}$ reference voltage. Since the output of the comparator is coupled to the input IN', the output equals $V_{be}+(R_1+R2)/R1\ \Delta V_{be}$. Accordingly, the output voltage is a constant voltage equal to $V_{be}$ plus a constant times $\Delta V_{be}$. With the appropriate selection of resistors R1 and R2, the output can remain constant.

Figure 6:
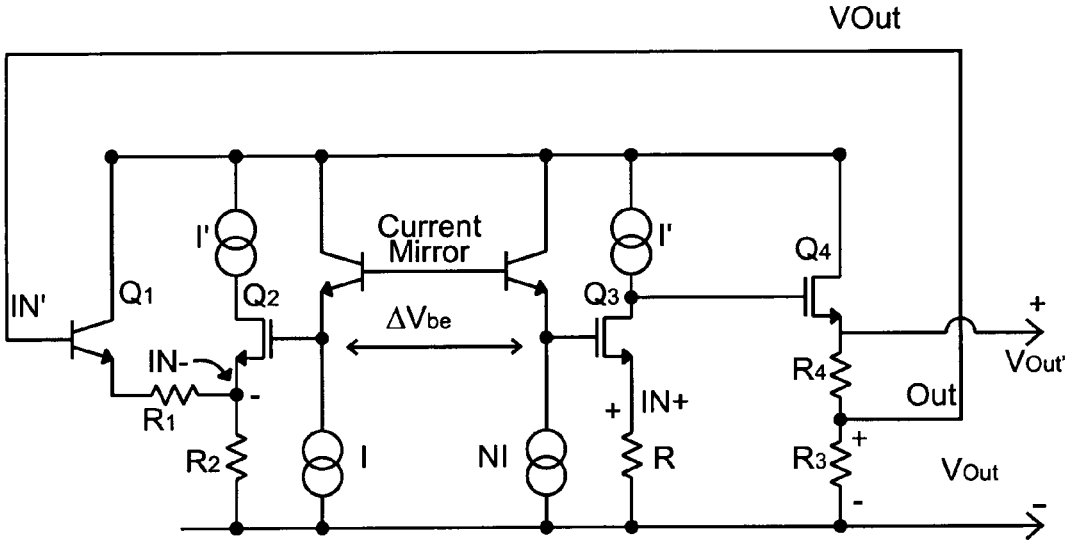
FIG. 6 shows a schematic diagram of an implementation of the circuit of the invention.

FIG. 6 shows a complete circuit implementation where a current mirror circuit has been substituted for $\Delta V_{be}$ in FIG. 4. In addition, the comparator has been implemented by FETs Q2, Q3 and Q4 serving as a differential amplifier. The inputs IN− and IN+ are provided respectively at the sources of transistors Q2 and Q3 and the output OUT=VREF is provided at the source of transistor Q4. $\Delta V_{be}$ is provided by the current mirror across the gates of the transistors Q2 and Q3. In FIG. 6, a voltage divider comprising resistors R3 and R4 is provided.

$$V_{out'} = V_{out}\left(\frac{R_3 + R_4}{R_3}\right)$$

In this way, the circuit can generate a reference voltage Vout' that is a multiple of Vout. This is important in applications where a 1.25 V reference voltage is too low.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A bandgap voltage reference circuit comprising:

a first bipolar transistor providing substantially a reference voltage $V_{be}$;

a current mirror circuit comprising two bipolar transistors coupled in a current mirror arrangement for providing a voltage difference $\Delta V_{be}$ comprising substantially a difference signal between the respective $V_{be}$ voltages of the two bipolar transistors; and a comparator having respective inputs receiving voltages representative of $V_{be}$ and $\Delta V_{be}$ and an output coupled to the base of the first bipolar transistor whereby a voltage representative of the sum of respective constants multiplying $V_{be}$ and $\Delta V_{be}$ is provided at the output of the comparator.

2. A bandgap voltage reference circuit comprising:

a first circuit providing a first voltage representative of $V_{be}$ of a first bipolar transistor;

a current mirror circuit comprising two additional bipolar transistors coupled in a mirror arrangement for providing a second voltage $\Delta V_{be}$ representative of the difference of the two $V_{be}$ voltages of the two additional bipolar transistors; and a comparator having respective inputs receiving voltages representative of $V_{be}$ and $\Delta V_{be}$ and an output coupled to the base of the first bipolar transistor whereby a substantially temperature independent voltage reference is provided at the output of the comparator.

* * * * *